US009199489B2

(12) United States Patent
Ikagawa et al.

(10) Patent No.: US 9,199,489 B2
(45) Date of Patent: Dec. 1, 2015

(54) PRINT CONTROL DEVICE, PRINTING DEVICE AND PRINTING METHOD

(71) Applicant: SEIKO EPSON CORPORATION, Tokyo (JP)

(72) Inventors: Takamasa Ikagawa, Nagano (JP); Atsushi Nakazawa, Nagano (JP); Yu Shinagawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,134

(22) Filed: Mar. 24, 2014

(65) Prior Publication Data

US 2014/0292846 A1 Oct. 2, 2014

(30) Foreign Application Priority Data

Mar. 28, 2013 (JP) ..... 2013-068280

(51) Int. Cl.
*B41J 29/38* (2006.01)
*B41J 11/00* (2006.01)
*B41J 25/308* (2006.01)

(52) U.S. Cl.
CPC ..... *B41J 11/0065* (2013.01); *B41J 11/008* (2013.01); *B41J 25/3088* (2013.01)

(58) Field of Classification Search
CPC ..... B41J 25/308; B41J 11/0065; B41J 11/008
See application file for complete search history.

(56) References Cited

U.S. PATENT DOCUMENTS 6,109,745 A * 8/2000 Wen ..... 347/101
2007/0291056 A1 12/2007 Tanahashi et al.

FOREIGN PATENT DOCUMENTS

JP 2007-331297 A 12/2007

* cited by examiner

*Primary Examiner* — Julian Huffman
(74) *Attorney, Agent, or Firm* — Global IP Counselors, LLP

(57) ABSTRACT

The object of the invention is to effectively prevent a medium from swelling due to ejected liquid, and prevent a head and the medium from contacting each other. When "strong rubbing prevention" is selected in the "rubbing prevention settings", the margin amount of the paper P is enlarged and printing is conducted. Therefore, by enlarging the margin amount, the paper can be prevented from swelling due to ejected ink, and the paper and the printing head can be more reliably prevented from contacting each other (paper rubbing).

8 Claims, 10 Drawing Sheets

PLAIN PAPER (PRINT GRADE: STANDARD)

| PRINTING DUTY (%) | MARGIN AT TOP AND BOTTOM (mm) | | | | | |
|---|---|---|---|---|---|---|
| | 5 | 10 | 15 | 17 | 20 | 25 |
| 50 | O | O | O | O | O | O |
| 60 | × | × | × | × | × | O |
| 70 | × | × | × | × | × | O |
| 80 | × | × | × | × | × | × |
| 90 | × | × | × | × | × | × |
| 100 | × | × | × | × | × | × |

O: HEAD RUBBING OCCURRENCE RATIO IS LOW ×: HEAD RUBBING OCCURRENCE RATION IS HIGH

Fig. 13A

PLAIN PAPER (PRINT GRADE: CLEAN)

| PRINTING DUTY (%) | MARGIN AT TOP AND BOTTOM (mm) | | | | | |
|---|---|---|---|---|---|---|
| | 5 | 10 | 15 | 17 | 20 | 25 |
| 50 | × | × | O | O | O | O |
| 60 | × | × | O | O | O | O |
| 70 | × | × | O | O | O | O |
| 80 | × | × | O | O | O | O |
| 90 | × | × | × | × | O | O |
| 100 | × | × | × | × | × | O |

Fig. 13B

PRINT CONTROL DEVICE, PRINTING DEVICE AND PRINTING METHOD

CROSS-REFERENCE TO RELATED APPLICATIONS

This application claims priority to Japanese Patent Application No. 2013-068280 filed on Mar. 28, 2013. The entire disclosure of Japanese Patent Application No. 2013-068280 is hereby incorporated herein by reference.

BACKGROUND

1. Technical Field

The present invention relates to a print control device, a printing device and a printing method for controlling a printing mechanism in which an image is printed to a medium by ejecting liquid from a head onto the medium.

2. Background Technology

As the print control device of this type, a device has been proposed, in which a sensor for detecting the size of paper in the vertical direction and the horizontal direction is provided, and the distance between a recording head and paper (platen gap) is made larger in a case in which a direction of placing paper is determined to be horizontal with respect to the feed direction than in a case in which it is determined to be vertical (for example, see Patent Document 1). In this device, it is contended that the paper and the recording head can be prevented from contacting each other and contamination on the recording surface of the paper can be prevented from occurring by increasing the platen gap.

Japanese Laid-open Patent Publication No. 2007-331297 (Patent Document 1) is an example of the related art.

SUMMARY

Problems to be Solved by the Invention

However, the above-described device can not be able to sufficiently prevent the recording head and the paper from contacting each other. For example, in a case in which the print area is large with respect to the paper such as a case in which printing is conducted by ejecting ink onto the entire paper, the paper swells significantly by the ejected ink and deformation of the paper becomes significant. Thus, even if the distance between the recording head and the paper is increased, there are cases in which the recording head and the paper cannot be sufficiently prevented from contacting each other.

The main object of the print control device, the printing device and the printing method of the invention is to effectively prevent a medium from swelling due to ejected liquid and more reliably prevent a head and the medium from contacting each other.

In order to achieve the above-described main object, the print control device, the printing device and the printing method of the invention are implemented as follows.

Means Used to Solve the Above-Mentioned Problems

According to the invention, a print control device, that controls a printing mechanism for conducting printing of an image to a medium by ejecting liquid from a head onto the medium, controls the printing mechanism to conduct printing with enlarging a margin amount in the medium so as to prevent the head and the medium from contacting each other.

In the print control device of the invention, the printing mechanism is controlled to conduct printing with enlarging a margin amount in the medium so as to prevent the head and the medium from contacting each other. With this configuration, it is possible to effectively prevent the medium from swelling due to the ejected liquid and prevent the head and the medium from contacting each other.

In the print control device of the invention that controls the printing mechanism, the printing mechanism includes a distance adjusting means (unit) for adjusting a distance between the head and the medium. In a case in which printing is conducted with enlarging a margin amount in the medium, the distance adjusting means (unit) is controlled to make a distance between the head and the medium larger than that of a case in which printing is conducted without enlarging a margin amount in the medium. In this manner, by increasing the distance between the medium and the head in association with enlarging the margin amount in the medium, the head and the medium can be more reliably prevented from contacting each other.

In the print control device of the invention that controls the printing mechanism, the printing mechanism is capable of conducting borderless printing in which printing is conducted so as not to create a margin in the medium. The print control device includes an enlarged margin printing selection means (unit) for determining whether printing is to be conducted with enlarging a margin amount in the medium or not prior to conducting printing so as to prevent the head and the medium from contacting each other, and a borderless printing selection means (unit) for determining whether the borderless printing is to be conducted or not prior to conducting printing. The borderless printing selection means (unit) can be configured so as not to determine that the borderless printing is to be conducted when the enlarged margin printing selection means (unit) determines that printing is to be conducted with enlarging a margin amount in the medium. With this configuration, since printing is not conducted with enlarging a margin amount in the medium in a case in which the borderless printing can be selected, it is possible to prevent print results that a user does not expect from occurring.

Further, in the print control device of the invention, in a case in which printing is conducted with enlarging a margin amount in the medium, the printing mechanism is controlled to make an ejection amount of liquid per unit area with respect to the medium smaller than that of a case in which printing is conducted without enlarging a margin amount in the medium. In this manner, an amount of the medium swelling due to the ejected liquid can be made smaller, and the head and the medium can be more reliably prevented from contacting each other.

In the print control device of the invention that controls the printing mechanism, the print control device includes a movement means (unit) for moving the head forward and backward, and the printing mechanism is controlled to conduct printing in a unidirectional printing mode in which printing is conducted by ejecting liquid from the head in only one of forward movement and backward movement, or in a bidirectional printing mode in which printing is conducted by ejecting liquid from the head in both of forward movement and backward movement. In a case in which printing is conducted with enlarging a margin amount, the printing mechanism can be controlled to conduct printing in the unidirectional printing mode. It is assumed that a better print quality can be obtained in the unidirectional printing than in the bidirectional printing. Therefore, by using the unidirectional printing in a case in which the medium might swell due to the ejected liquid, the print quality can be prevented from being deteriorated.

The print control device of the invention can include a margin amount setting means (unit) for setting a margin amount based on an operation by a user, and a notification means (unit) for notifying a user that printing is conducted with enlarging the margin amount when such printing is conducted. In this manner, a user can know in advance that printing is not conducted with the margin amount set by the user. It is thus possible to prevent print results that a user does not expect from occurring.

The print control device of the invention can include an enlarged margin amount setting means (unit) for setting an enlarged amount of the margin amount based on a plurality of parameters in a case in which printing is conducted with enlarging the margin amount. In this manner, it is possible to optimize the enlarged margin amount based on a plurality of parameters.

The print control device of the invention can include an enlarged margin printing selection means (unit) for determining whether printing is to be conducted with enlarging a margin amount or not based on a selection by a user. In a default setting of the enlarged margin printing selection means, it is determined that printing is conducted without enlarging the margin amount. In this manner, printing can be normally conducted without enlarging the margin amount of the medium, and printing can be conducted with enlarging the margin amount of the medium when it is necessary.

According to the invention, a printing device, for conducting printing of an image to a medium by ejecting liquid onto the medium based on control by a print control device that includes a margin amount setting means (unit) for setting a margin amount by a selection of a user, includes a head for ejecting liquid, a distance adjusting means (unit) for adjusting a distance between the head and the medium, and a control means (unit) for selecting one of a plurality of print modes including a first print mode in which a distance between the head and the medium is adjusted to be a first distance by the distance adjusting means (unit) and printing is conducted based on a margin amount set by the margin amount setting means (unit) and a second print mode in which a distance between the head and the medium is adjusted to be a second distance that is larger than the first distance by the distance adjusting means (unit) and printing is conducted based on a margin amount that is larger than the margin amount set by the margin amount setting means, and controlling the head and the distance adjusting means (unit) to conduct printing in the selected print mode.

In the printing device of the invention, the margin amount is set by a selection of a user, one of a plurality of print modes is selected, the plurality of print modes including a first print mode in which a distance between the head and the medium is adjusted to be a first distance and printing is conducted based on the set margin amount and a second print mode in which a distance between the head and the medium is adjusted to be a second distance that is larger than the first distance and printing is conducted based on a margin amount that is larger than the set margin amount, and the distance adjusting means (unit) for adjusting a distance between the head and the medium is controlled to conduct printing in the selected print mode. With this configuration, the margin amount can be optimized and the medium can be prevented from swelling due to the ejected liquid by selecting and conducting one of the plurality of print modes including the first print mode and the second print mode. As a result of this, the head and the medium can be prevented from contacting each other. In particular, in the second print mode, by increasing the distance between the medium and the head in association with enlarging the margin amount in the medium, the head and the medium can be more reliably prevented from contacting each other.

According to the invention, a first printing method for conducting printing of an image to a medium by ejecting liquid from a head onto the medium conducts printing with enlarging a margin amount in the medium so as to prevent the head and the medium from contacting each other.

In the first printing method of the invention, printing is conducted with enlarging a margin amount in the medium so as to prevent the head and the medium from contacting each other. It is thus possible to effectively prevent the medium from swelling due to the ejected liquid and prevent the head and the medium from contacting each other.

According to the invention, a second printing method, for conducting printing of an image to a medium by ejecting liquid from a head onto the medium, includes setting a margin amount by a selection of a user, selecting one of a plurality of print modes including a first print mode in which a distance between the head and the medium is adjusted to be a first distance and printing is conducted based on the set margin amount and a second print mode in which a distance between the head and the medium is adjusted to be a second distance that is larger than the first distance and printing is conducted based on a margin amount that is larger than the set margin amount set, and conducting printing in the selected print mode.

In the second printing method of the invention, a printing mechanism is controlled such that the margin amount is set by a selection of a user, one of a plurality of print modes is selected, the plurality of print modes including a first print mode in which a distance between the head and the medium is adjusted to be a first distance and printing is conducted based on the set margin amount and a second print mode in which a distance between the head and the medium is adjusted to be a second distance that is larger than the first distance and printing is conducted based on a margin amount that is larger than the set margin amount, and printing is conducted in the selected print mode. With this configuration, the margin amount can be optimized and the medium can be prevented from swelling due to the ejected liquid by selecting and conducting one of the plurality of print modes including the first print mode and the second print mode. As a result of this, the head and the medium can be prevented from contacting each other. In particular, in the second print mode, by increasing the distance between the medium and the head in association with enlarging the margin amount in the medium, the head and the medium can be more reliably prevented from contacting each other.

BRIEF DESCRIPTION OF THE DRAWINGS

Referring now to the attached drawings which form a part of this original disclosure:

FIGS. 13A and 13B are explanatory diagrams that show a relationship between a margin amount and a printing duty, and a paper rubbing occurrence ratio.

DETAILED DESCRIPTION OF EXEMPLARY EMBODIMENTS

Figure 1:
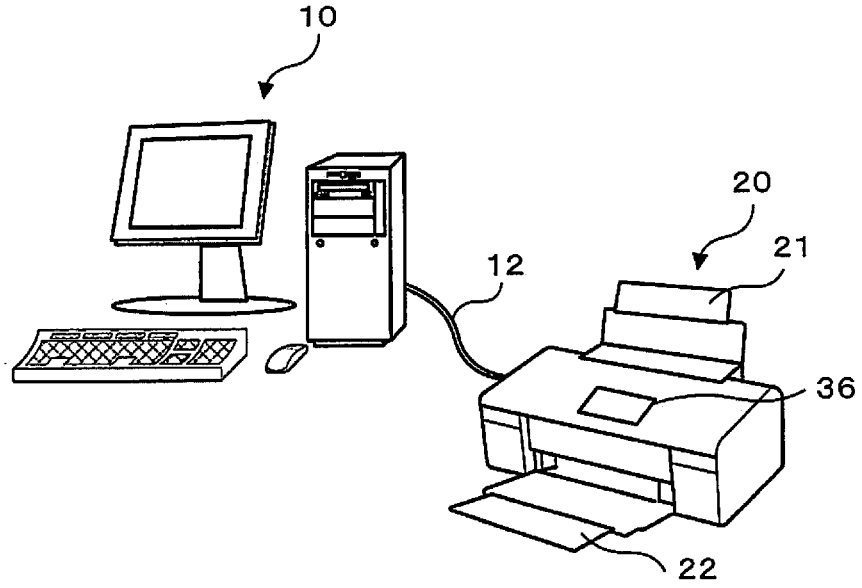
FIG. 1 is an external view of a printer 20 according to an embodiment of the invention.
Figure 2:
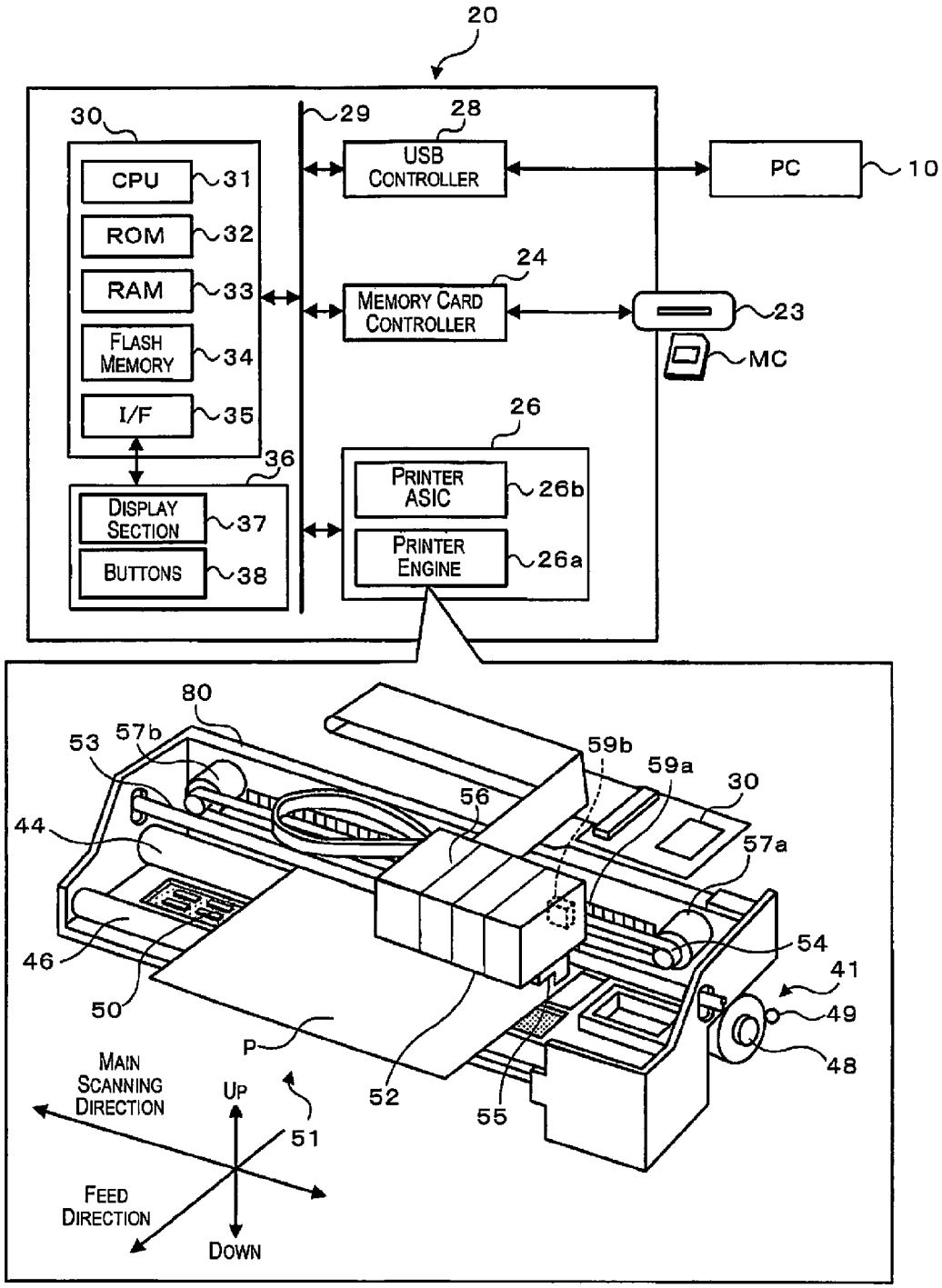
FIG. 2 is a schematic configuration diagram of the printer 20 of the present embodiment.
Figure 3:
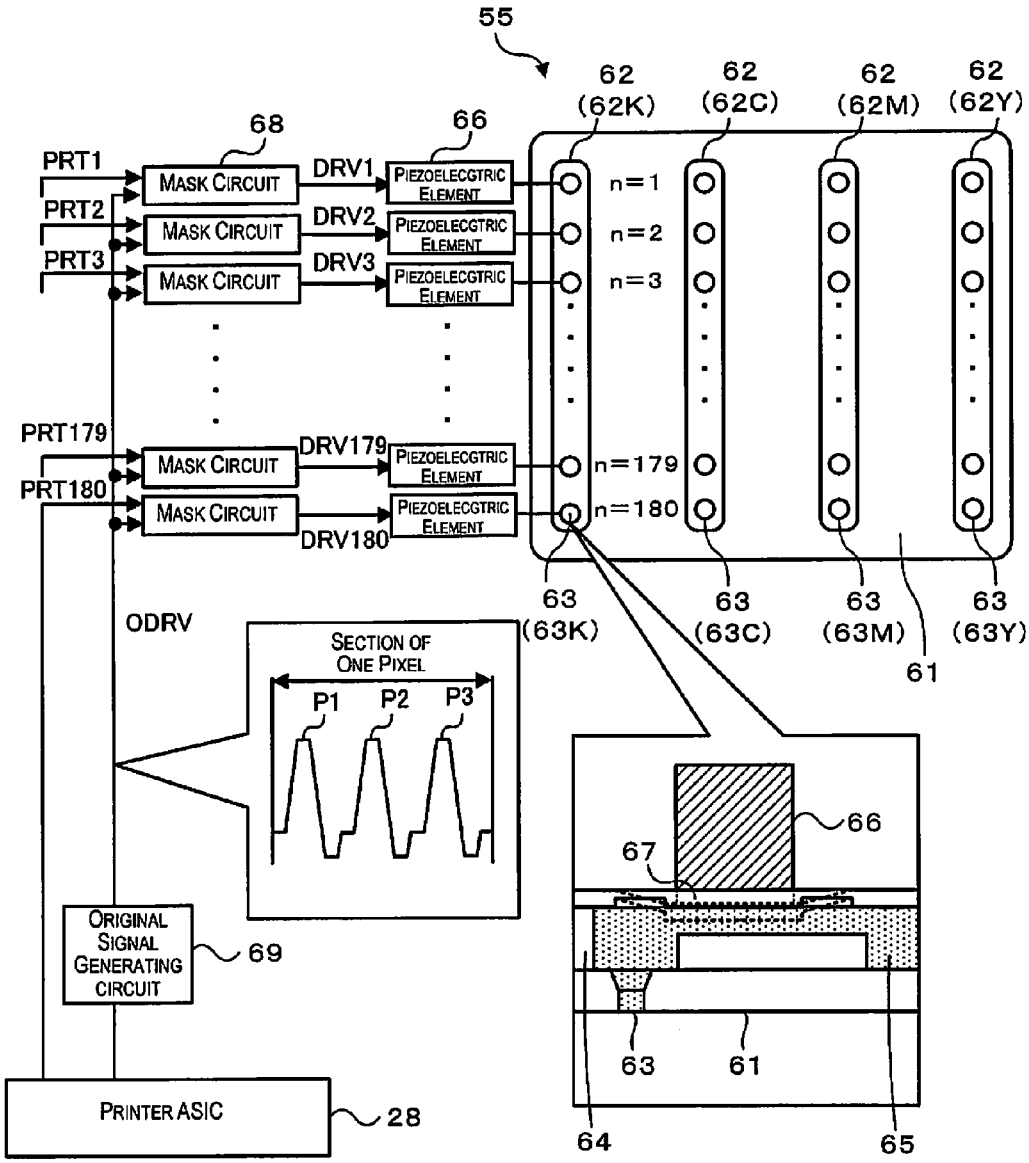
FIG. 3 is an explanatory diagram that shows electrical connection of a printing head 55.
Figure 4:
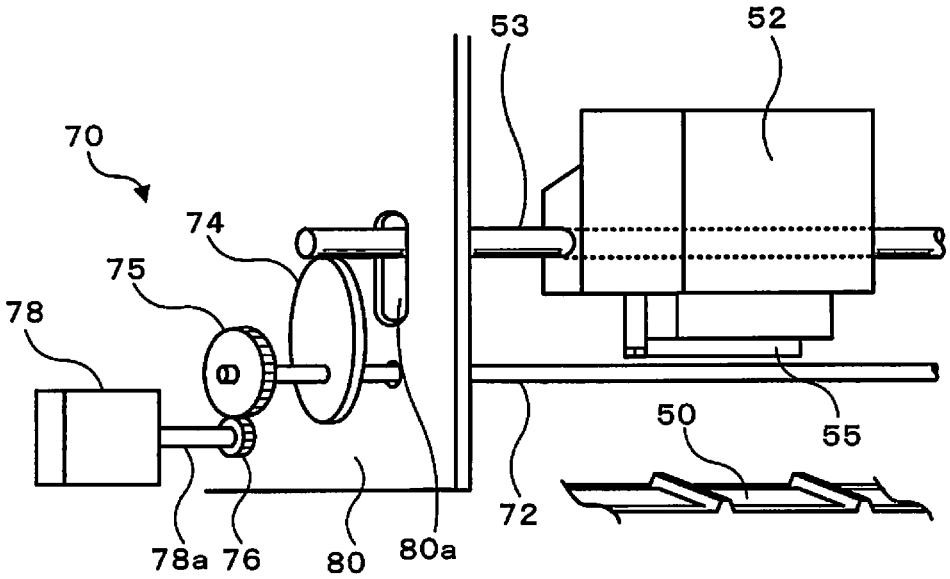
FIG. 4 is a schematic configuration diagram of a platen gap adjusting mechanism 70.

Hereinafter, an embodiment of the invention will be explained with reference to the drawings. FIG. 1 is an external view that shows the outer appearance of a printer 20 according to an embodiment of the invention. FIG. 2 is a configuration diagram that shows a schematic configuration of the printer 20 of the present embodiment. FIG. 3 is an explanatory diagram that shows electrical connection of a printing head 55. FIG. 4 is a configuration diagram that shows a schematic configuration of a platen gap adjusting mechanism 70.

As shown in the drawings, the printer 20 of the present embodiment is configured as an inkjet printer in which printing is conducted by ejecting ink of each color of CMYK, i.e., cyan (C), magenta (M), yellow (Y), or black (K) onto paper P fed from a paper feed tray 21 based on print data, and the paper P is discharged to a paper discharge tray 22. The printer 20 has a printer unit 26, a card controller 24, a USB controller 28, an operation panel 36, and a main controller 30. The printer unit 26 conducts printing. The card controller 24 conducts reading and writing of a file that stores data with respect to a memory card MC inserted into a memory card slot 23. The USB controller 28 is for conducting communication with a computer 10 through a USB cable 12. The operation panel 36 is used for causing a display section 37 to display a menu screen, a print setting screen, and the like, or inputting instructions on various kinds of print settings, print start instructions, and the like through an operation of buttons 38 by a user. The main controller 30 controls the entire printer. The printer 20 is configured such that the printer unit 26, the memory card controller 24, the USB controller 28, and the main controller 30 can exchange various kinds of control signals or data with each other through a bus 29.

The memory card controller 24 conducts inputting and outputting of data with respect to a memory card MC inserted into the memory card slot 23. In a state in which a memory card MC is inserted into the memory card slot 23, the memory card controller 24 reads out image data stored in the memory card MC and transmits the image data to the main controller 30, or writes data in the memory card MC based on a command input from the main controller 30.

The printer unit 26 has a printer engine 26*a*, and a printer ASIC 26*b* that controls the printer engine 26*a*. As shown in FIG. 2, the printer engine 26*a* has a paper feed mechanism 41, a head driving mechanism 51, and the platen gap adjusting mechanism 70 (see FIG. 4). The paper feed mechanism 41 feeds the paper P from the back to the front in the drawings by driving a delivery roller 44 with a delivery motor 48. The head driving mechanism 51 conducts printing by ejecting ink drops from the printing head 55 onto the paper P fed onto a platen 50 by the paper feed mechanism 41. The platen gap adjusting mechanism 70 adjusts a distance between nozzles 63 of the printing head 55 and an upper surface of the platen 50 (hereinafter referred to as a platen gap PG).

The head driving mechanism 51 has a carriage motor 57*a*, a driven roller 57*b*, a carriage belt 54, a carriage 52, an ink cartridge 56, and the printing head 55. The carriage motor 57*a* is disposed on the right side of a mechanical frame 80. The driven roller 57*b* is disposed on the left side of the mechanical frame 80. The carriage belt 54 is laid between the carriage motor 57*a* and the driven roller 57*b*. The carriage 52 is reciprocated to the right and left along a guide 53 by the carriage belt 54 in accordance with driving of the carriage motor 57*a*. The ink cartridge 56 is installed to the carriage 52, and separately stores ink of each color including yellow (Y), magenta (M), cyan (C), and black (K) that contain dyes or pigments as coloring agents in water as a solvent. The printing head 55 receives ink supplied from the ink cartridge 56 and ejects ink drops. An optical scale 59*a* is attached to the mechanical frame 80 along the movement direction of the carriage 52, and an optical sensor 59*b* is attached to the back surface of the carriage 52 so as to face the optical scale 59*a*. The optical sensor 59*b* includes a light emitting element (for example, a light emitting diode) and a light receiving element (for example, a phototransistor). Light is emitted from the light emitting element of the optical sensor 59*b* toward the optical scale 59*a* is received by the light receiving element, so that the position of the carriage 52 in the right and left direction (the main scanning direction) can be detected.

As shown in FIG. 3, the printing head 55 has a nozzle plate 61, a cavity plate 64, a vibration plate 67, a piezoelectric element 66, and a mask circuit 68. The nozzle plate 61 is made of stainless steel in which four nozzle lines 62C, 62M, 62Y, and 62K are formed by aligning nozzles 63C, 63M, 63Y, and 63K for cyan (C), magenta (M), yellow (Y), or black (K), respectively. For each color, a plurality of nozzles are provided (in the present embodiment, the number is 180). The cavity plate 64 forms an ink chamber 65 with the nozzle plate 61, and the ink chamber 65 connects to the nozzles 63. The vibration plate 67 is made of ceramic (for example, made of zirconia ceramic) and serves as the upper wall of the ink chamber 65. The piezoelectric element 66 (for example, lead zirconate titanate or the like) is attached to the upper surface of the vibration plate 67. The mask circuit 68 outputs a driving signal to the piezoelectric element 66 as a driving circuit. In the printing head 55, a voltage is applied from the mask circuit 68 to the piezoelectric element 66 and the upper wall of the ink chamber 65 is pressed down by the piezoelectric element 66, so that pressure is applied to ink and ink drops are ejected from the nozzles 63. Here, the nozzles 63C, 63M, 63Y, and 63K are collectively referred to as the nozzles 63, and the nozzle lines 62C, 62M, 62Y, and 62K are collectively referred to as the nozzle lines 62. Hereinafter, driving of the printing head 55 is explained with reference to the nozzle 63K for black (K).

The mask circuit 68 inputs an original signal ODRV generated by an original signal generating circuit 69 and a print signal PRTn, and generates a driving signal DRVn based on the original signal ODRV and the print signal PRTn that have been input so as to output the driving signal DRVn to the piezoelectric element 66. The "n" at the end of the print signal PRTn and the "n" at the end of the driving signal DRVn are numbers to identify the nozzles included in the nozzle line. In the present embodiment, since the nozzle line has 180 nozzles, the "n" is an integer value of one of 1 to 180. The original signal generating circuit 69 outputs to the mask circuit 68 a signal in which three pulses including a first pulse P1, a second pulse P2, and a third pulse P3 are a repeating unit in a section of one pixel (within a period of time required for the carriage 52 to traverse a section of one pixel) as the original signal ODRV. The mask circuit 68 to which the original signal ODRV has been input outputs only a necessary pulse to the piezoelectric element 66 of the nozzle 63K as the driving signal DRVn by masking an unnecessary pulse among the three pulses included in the original signal ODRV based on the print signal PRTn that has been input separately. In this instance, when only the first pulse P1 is output to the piezoelectric element 66 as the driving signal DRVn, a dot of a small size (small dot) is formed on the paper P by ejecting one shot of ink drops from the nozzle 63K. When the first pulse P1 and the second pulse P2 are output to the piezoelectric element 66, a dot of a medium size (medium dot) is formed on the paper P by ejecting two shots of ink drops from the nozzle 63K. When the first pulse P1, the second pulse P2, and the third pulse P3 are output to the piezoelectric element 66, a dot of a large size (large dot) is formed on the paper P by ejecting three shots of ink drops from the nozzle 63K. In the printer 20, therefore, dots of three different sizes can be formed by adjusting the amount of ink ejected in a section of one pixel. The nozzles 63C, 23M and 23Y, and the nozzle lines 62C, 43M and 43Y of colors other than black (K) are configured in the same manner as the nozzle 63K and the nozzle line 62K described above.

The paper feed mechanism 41 has a paper feed roller (not shown in the drawings), the delivery roller 44, a paper discharge roller 46, and the delivery motor 48. The paper feed roller feeds the paper P set on the paper feed tray 21 that is the supply end of the paper P. The delivery roller 44 delivers the paper P fed by the paper feed roller onto the platen 50 that faces the printing head 55. The paper discharge roller 46 discharges the paper P to the paper discharge tray 22 that is the discharge end of the paper P. The delivery motor 48 drives the paper feed roller, the delivery roller 44, and the paper discharge roller 46 by rotation. Driven rollers, that are not shown in the drawings, are arranged to contact the delivery roller 44 and the paper discharge roller 46, respectively. The paper P is delivered in a state of being sandwiched between the rollers. A rotation angle sensor 49 for detecting a rotation angle is attached to the rotation axis of the delivery motor 48, so that driving of the delivery motor 48 is controlled based on the rotation angle detected by the rotation angle sensor 49. Here, the driving control can be conducted based on the rotation amount of one roller such as the delivery roller 44 or the like.

As shown in FIG. 4, the platen gap adjusting mechanism 70 has a rotatable shaft 72, cams 74, a reducing gear 75, and a gap adjusting motor 78. The shaft 72 is provided below the guide 53 of the carriage 52 so as to be parallel to the guide 53. The cams 74 are attached to both ends of the shaft 72 such that the cam surfaces contact the guide 53. The reducing gear 75 is attached to one end of the shaft 72. In the gap adjusting motor 78, a gear 76 meshing with the reducing gear 75 is attached to a rotation axis 78*a*. A vertically elongated through hole 80*a* is formed in the mechanical frame 80 such that the guide 53 is allowed to move only in the vertical direction. When the cam 74 is rotated in association with rotation of the shaft 72 by driving of the motor 78, the distance between the cam surface contacting the guide 53 and the rotation axis of the cam 74 is changed corresponding to the rotation angle, which causes the guide 53 to move in the vertical direction along the through hole 80*a*. In this manner, the distance between the printing head 55 (the nozzles 63) and the platen 50, that is, the platen gap is adjusted.

The operation panel 36 has the display section 37 for displaying letters, figures, symbols, and the like, and the buttons 38 arranged around the display section 37. Although they are not shown in the drawings, the buttons 38 include a power button for turning on or off the power, a print button for instructing print execution, a setting button for calling up a print setting screen, arrows buttons such as an up arrow button, a down arrow button, a right arrow button, and a left arrow button for selecting a desired option from a plurality of options displayed on the display section 37, an OK button for entering a selection, and a cancel button for cancelling settings.

As shown in FIG. 1, the main controller 30 is configured as a microprocessor in which a CPU31 is a main component, and also includes a ROM 32 for storing various kinds of processing programs, a RAM 33 for temporarily storing data or saving data, a flash memory 34 that is capable of writing and erasing data, and an interface (I/F) 35. To the main controller 30, an image file is input through the memory card controller 24 from the memory card MC inserted into the memory card slot 23, data received from the computer 10 is input through the USB controller 28, a command signal from the buttons 38 of the operation panel 36 is input through the I/F 35, and a detection signal from various kinds of sensors for detecting the driving state of the printer engine 26*a* (for example, the optical sensor 59*b* for detecting the position of the carriage 52 or the rotation angle sensor 49 for detecting the rotation angle of the delivery motor 48) is input through the printer ASIC 26*b*. From the main controller 30, data to be transmitted to the computer 10 is output to the USB device controller 28, a control signal to the display section 37 of the operation panel 36 is output through the I/F 35, and a drive command of the printer engine 26*a* is output to the printer ASIC 26*b*. A print buffer area is provided in the RAM 33, and print data transmitted from the computer 10 through the USB controller 28 is stored in the print buffer area.

In the printer 20 of the present embodiment configured above, when the setting button is pressed, the print setting screen is displayed and the selection of various items is received. Examples of the print setting screen are shown in FIGS. 5(*a*) and (*b*). In the present embodiment, as shown in the drawings, the print setting screen includes items such as "paper size settings" for selecting the size of the paper P (for example, A4, B5, L-size, or postcard), "paper kind settings" for selecting the kind of the paper P (for example, plain paper or glossy paper), "borderless settings" for selecting execution or non-execution of borderless printing, "print grade settings" for selecting print grade (for example, clean, standard or fast), "trimming settings" for conducting trimming of a print image, "bidirectional printing settings" for determining whether unidirectional printing is conducted or bidirectional printing is conducted, "automatic image quality correction settings" for determining whether automatic image quality correction of a print image is conducted or not, and "rubbing prevention settings" for preventing rubbing between the paper P and the printing head 55 from occurring during printing. By selecting one of these items with the up and down buttons and pressing the OK button, a user can change the settings of the selected item. In the present embodiment, the default setting of the "paper size settings" is "A4", the default setting of the "paper kind settings" is "plain paper", the default setting of the "borderless settings" is "with border", the default setting of the "print grade settings" is "standard", the default setting of the "trimming settings" is "No", the default setting of the "bidirectional printing settings" is "bidirectional printing", the default setting of the "automatic image quality correction settings" is "No", and the default setting of the "rubbing prevention settings" is "No". In the present embodiment, the print setting screen is configured to display five setting items at a maximum on one screen. When the down button is pressed in a state in which the item at the bottom is selected, the next setting item can be displayed. When the up button is pressed in a state in which the item at the top is selected, the previous setting item can be displayed. Hereinafter, detailed explanations will be made on a case in which the "rubbing prevention settings" are selected and a case in which the "borderless settings" are selected on the print setting screen.

Figure 5A:
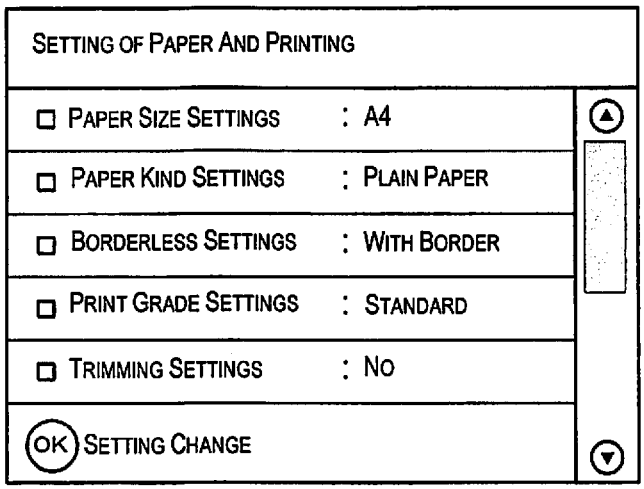
FIGS. 5A and 5B are explanatory diagrams that show an example of a print setting menu screen.
Figure 5B:
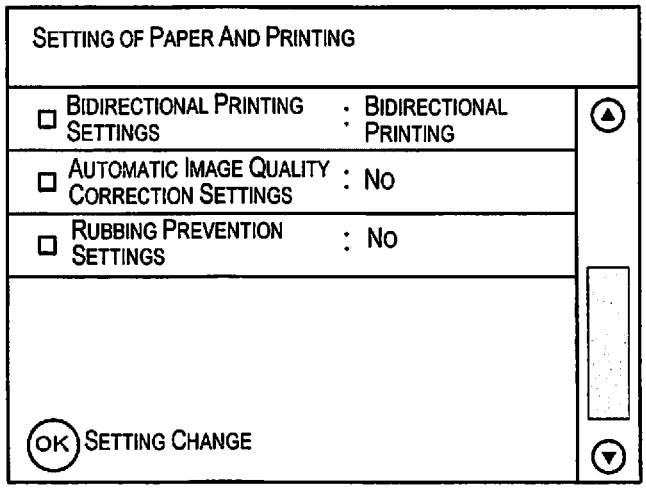
Figure 6:
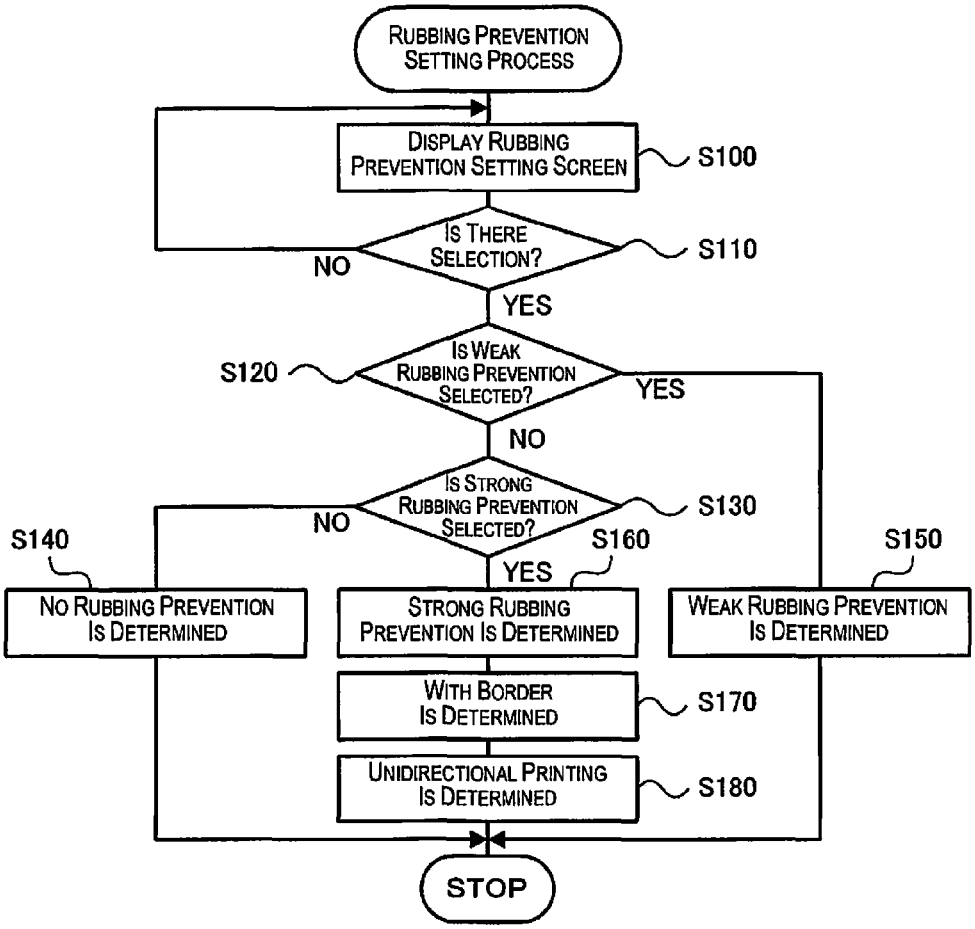
FIG. 6 is a flow chart that shows an example of a rubbing prevention setting process.
Figure 7:
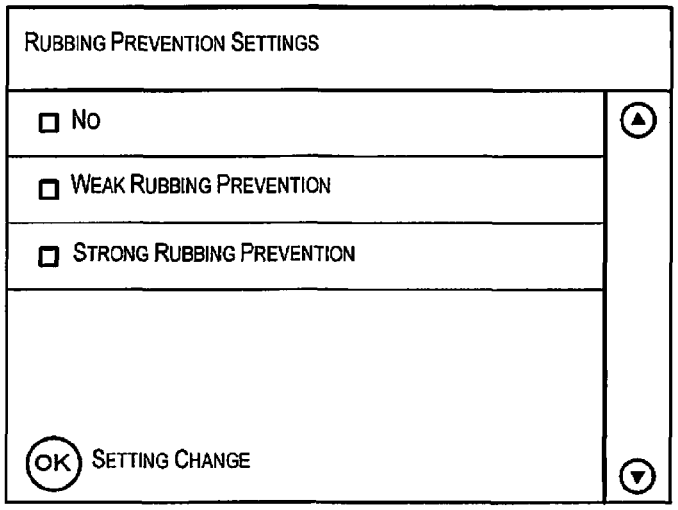
FIG. 7 is an explanatory diagram that shows an example of a rubbing prevention setting screen.

When the "rubbing prevention settings" are selected by a user on the print setting screen, a rubbing prevention setting process is executed. FIG. 6 is a flow chart that shows an example of a rubbing prevention setting process executed by the CPU 31 of the main controller 30. When the rubbing prevention setting process is executed, the CPU 31 of the main controller 30 displays the rubbing prevention setting screen (step S100) and waits for a selection of a user (step S110). FIG. 7 shows an example of the rubbing prevention setting screen. As shown in the drawing, the rubbing prevention setting screen has prepared items including "No" for not conducting rubbing prevention, "weak rubbing prevention" for conducting normal rubbing prevention, and "strong rubbing prevention" for conducting strong rubbing prevention. A user can select one of three options with the up button or the down button and can enter the selection by pressing the OK button. When a user selects one of the three options, it is judged whether the selected option is "weak rubbing prevention" or not (step S120), and it is judged whether the selected option is "strong rubbing prevention" or not (step S130), respectively. When it is judged that the selected option is not "weak rubbing prevention" nor "strong rubbing prevention", that is, it is judged that "No" is selected, no rubbing prevention is determined for the "rubbing prevention settings" (step S140), and then the rubbing prevention setting process is ended. On the other hand, when it is judged that the selected option is "weak rubbing prevention", weak rubbing prevention is determined for the "rubbing prevention settings" (step S150), and then the rubbing prevention setting process is ended. Further, when it is judged that the selected option is "strong rubbing prevention", strong rubbing prevention is determined for the "rubbing prevention settings" (step S160). At the same time, the "borderless settings" on the print setting screen shown in FIG. 5A are set to "with border" (step S170), the "bidirectional printing settings" on the print setting screen shown in FIG. 5B are set to "unidirectional printing" (step S180), and then the rubbing prevention setting process is ended. That is, when "strong rubbing prevention" is selected by a user, the "borderless settings" and the "bidirectional printing settings" that are setting items other than the "rubbing prevention settings" are forcibly set to "with border" and "bidirectional printing", respectively. The reasons for this will be described later.

Figure 8:
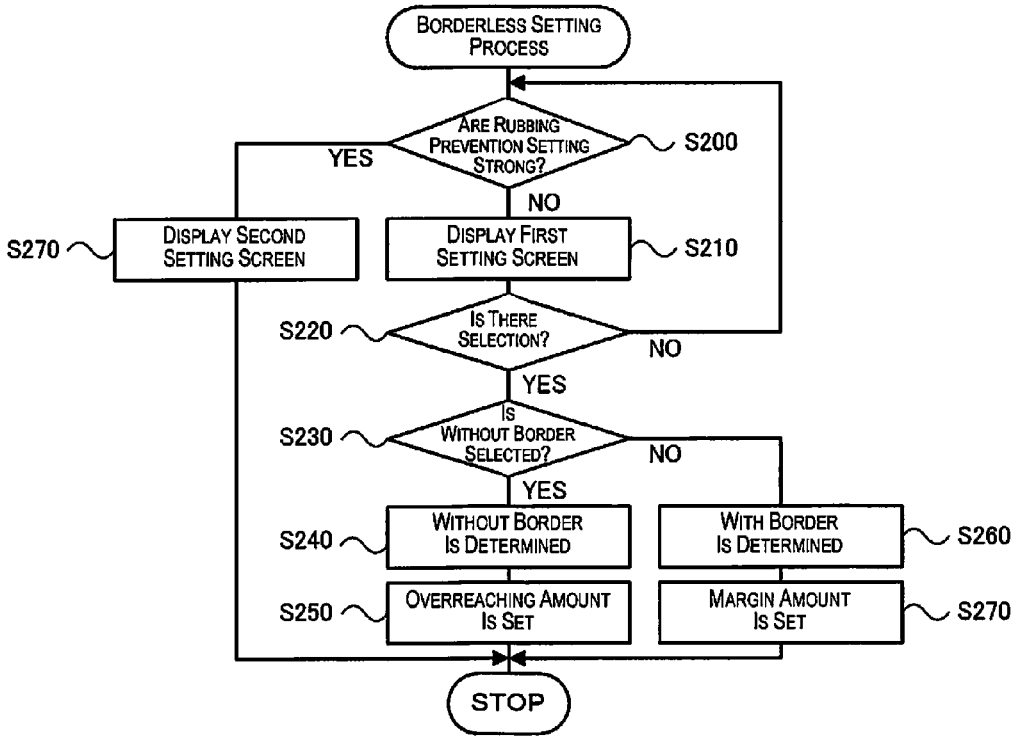
FIG. 8 is a flow chart that shows an example of a borderless setting process.
Figure 9:
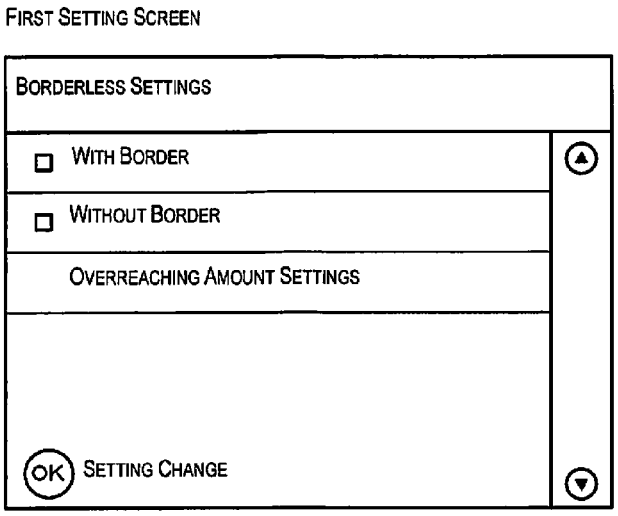
FIG. 9 is an explanatory diagram that shows an example of a first setting screen for borderless settings.
Figure 10:
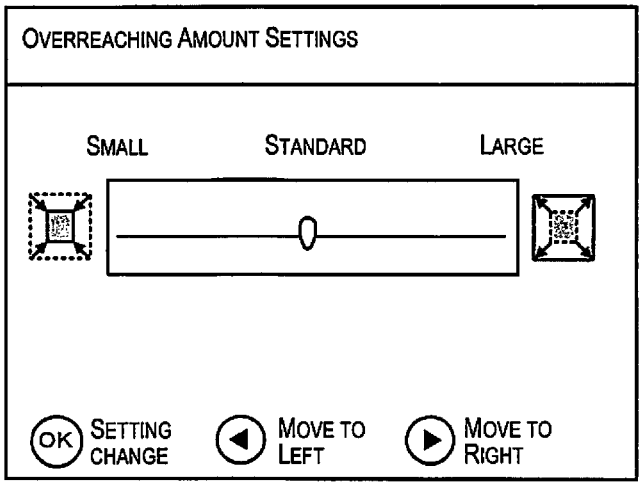
FIG. 10 is an explanatory diagram that shows an example of an overreaching amount setting screen.

When the "borderless settings" are selected by a user on the print setting screen, a borderless setting process is executed. FIG. 8 is a flow chart that shows an example of a borderless setting process executed by the CPU 31 of the main controller 30. When the borderless setting process is executed, the CPU 31 of the main controller 30 first judges whether the "rubbing prevention settings" are "strong rubbing prevention" or not (step S200). When it is judged that the "rubbing prevention settings" are not "strong rubbing prevention", that is, the "rubbing prevention settings" are either one of "no rubbing prevention" and "weak rubbing prevention", the CPU 31 of the main controller 30 displays a first setting screen for borderless settings (step S210) and waits for a selection of a user (step S220). FIG. 9 shows an example of the first setting screen for borderless settings. As shown in the drawing, the first setting screen has prepared items including "without border" for conducting borderless printing and "with border" for not conducting borderless printing. A user can select one of two options with the up button or the down button and can enter the selection by pressing the OK button. Further, in a case in which "without border" is selected on the first setting screen, an overreaching amount setting screen for setting an overreaching amount can be called up. FIG. 10 shows an example of the overreaching amount setting screen. As shown in the drawing, a slider that is movable in the right and left direction is provided on the overreaching amount setting screen. The state in which the slider is located in the center is a standard. The overreaching amount is increased as the slider moves to the right with respect to the standard and the overreaching amount is decreased as the slider moves to the left with respect to the standard. A user can determine the position of the slider by operating the right button or the left button, and can determine the overreaching amount corresponding to the position of the slider by pressing the OK button. The CPU 31 of the main controller 30 enlarges a print area as the overreaching amount determined by a user becomes large, and reduces a print area as the overreaching amount determined by a user becomes small. When one of the two options are selected by a user, it is judged whether the selected option is "without border" (step S230) or not. When it is judged that "without border" is selected, without border is determined for the "borderless settings" (step S240), the overreaching amount designated by the user is set (step S250), and then the borderless setting process is ended. On the other hand, when it is judged that "with border" is selected, with border is determined for the "borderless settings" (step S260), the margin amount designated by the user is set (step S270), and then the borderless setting process is ended. Here, in a case in which "with border" is selected for the "borderless settings", the margin amount can be set using a similar setting screen by replacing the "overreaching amount" in the case of selecting "without border" with the "margin amount". That is, the CPU 31 of the main controller 30 reduces a print area as the margin amount determined by a user becomes large, and enlarges a print area as the margin amount determined by a user becomes small.

Figure 11:
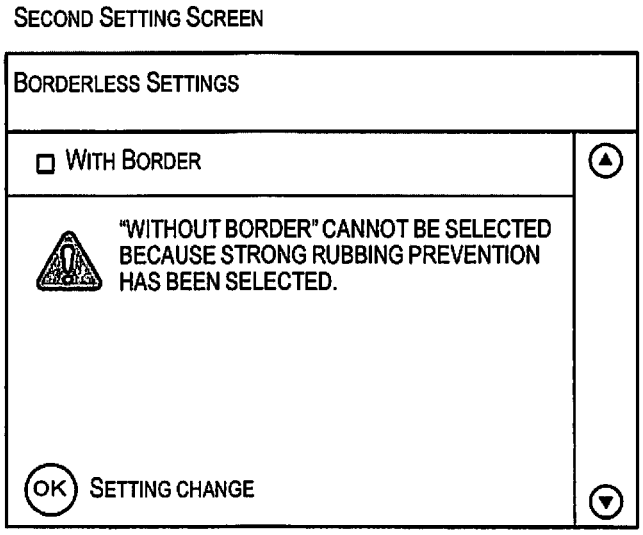
FIG. 11 is an explanatory diagram that shows an example of a second setting screen for borderless settings.

When it is judged that the "rubbing prevention settings" are "strong rubbing prevention" in step S200, a second setting screen for borderless settings is displayed (step S280), and the borderless setting process is ended. FIG. 11 shows an example of the second setting screen. As shown in the drawing, the second setting screen has only one prepared option of "with border", and a message that "without border" cannot be selected because "strong rubbing prevention" has been selected is displayed on the second setting screen at the same time. This is because with border is forcibly determined for the "borderless settings" when "strong rubbing prevention" is set. With this configuration, since a user can know that "without border" cannot be selected and the reason in advance, the user can select changing the "rubbing prevention settings" or continuing the printing with the settings of "with border".

Figure 12:
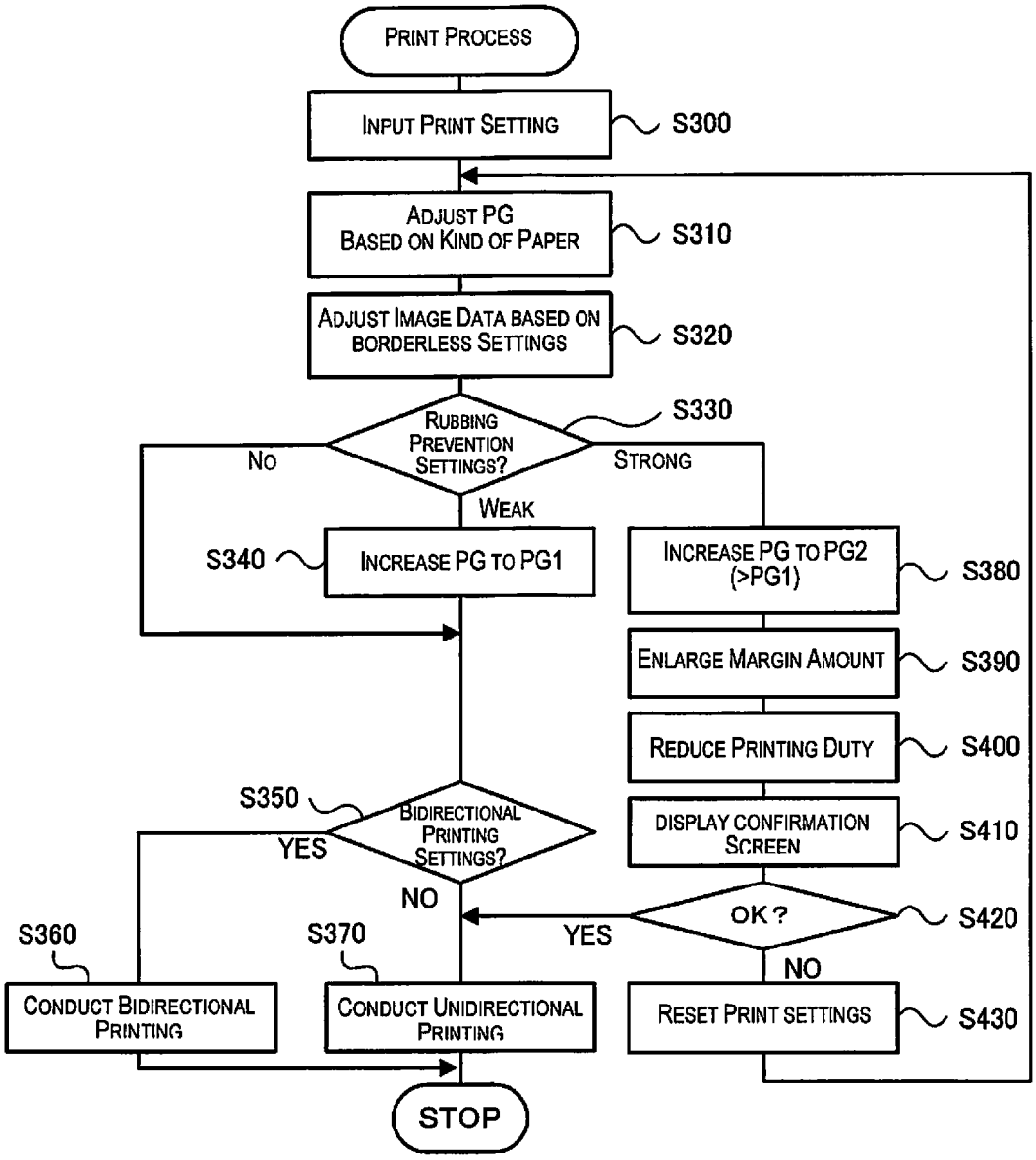
FIG. 12 is a flow chart that shows an example of a print process.

Next, explanations will be made on a print process executed in accordance with the print settings set as described above. FIG. 12 is a flow chart that shows an example of a print process routine executed by the main controller 30. This process is executed when a print start is instructed after a selection of an image to be printed and print settings are conducted by a user.

When the print process is executed, the CPU 31 of the main controller 30 first inputs the print settings (step S300). When the print settings are input, the platen gap PG is adjusted based on the kind of the paper included in the input print settings (step S310). Specifically, the process of step S310 is conducted by controlling the driving of the gap adjusting motor 78 so as to make the platen gap PG larger in a case in which the kind of the paper is plain paper than in a case in which it is glossy paper. For example, the platen gap PG is set to be 2.0 mm in a case of plain paper, and set to be 1.5 mm in a case of glossy paper. Subsequently, image data as the print target is adjusted based on the borderless settings included in the input print settings (step S320). Specifically, in a case in which without border is selected, the process of step S320 is conducted by adjusting image data such that an area including a paper area defined by the paper size included in the print settings and an overreaching area defined by an overreaching amount designated by a user corresponds to the print area. Also, in a case in which with border is selected, the process is conducted by adjusting image data such that an area obtained by subtracting a margin area defined by a margin amount designated by a user from a paper area defined by the paper size included in the print settings corresponds to the print area.

Next, it is judged whether the "rubbing prevention settings" are "no rubbing prevention", "weak rubbing prevention" or "strong rubbing prevention" (step S330). In a case in which the "rubbing prevention settings" are "no rubbing prevention", it is judged whether the "bidirectional printing settings" are "bidirectional printing" or not (step S350). When the answer is Yes, printing is conducted with bidirectional printing (step S360), and when the answer is No, printing is conducted with unidirectional printing (step S370). Then, the print process is ended.

When it is judged that the "rubbing prevention settings" are "weak rubbing prevention" in step S330, the driving of the gap adjusting motor 78 is controlled such that the platen gap PG is increased to a first distance PG1 irrespective of the value of the platen gap PG adjusted in step S310 (step S340). Then, the processes of step S350 to S370 are executed and the print process is ended. Here, the first distance PG1 is set as a distance that can prevent the paper P and the printing head 55 from contacting each other even when the paper P swells to some extent by ejection of ink. For example, the first distance PG1 can be set to be 2.5 mm. The reason why the platen gap PG is increased irrespective of the kind of the paper is because the printing head 55 (head) and the paper (medium) is more reliably prevented from contacting each other.

When it is judged that the "rubbing prevention settings" are "strong rubbing prevention" in step S330, the driving of the gap adjusting motor 78 is controlled such that the platen gap PG is increased to a second distance PG2 irrespective of the value of the platen gap PG adjusted in step S310 (step S380). Here, the second distance PG2 is set as a distance that is larger than the first distance PG 1. For example, the second distance PG2 can be set to be 3.0 mm. Then, the margin amount of the paper P is enlarged compared to a case of normal printing with border (step S390), and a printing duty is reduced (step S400). The margin amount is enlarged by reducing image data such that an area obtained by subtracting a margin area from a paper area defined by the paper size included in the print settings corresponds to the print area. Here, in enlarging the margin amount, the margins at the top, the bottom, the right, and the left can be enlarged uniformly with respect to the paper area, or the margins only at the top and the bottom can be enlarged. The printing duty refers to a total weight of ink drops that can be ejected for each unit area of the paper P. For example, the printing duty is reduced by adjusting the number of shots of ink drops or the weight of ink drops for each shot ejected from the nozzles 63 corresponding to print data in the mask circuit 68. Further, ink ejection onto the paper P is conducted based on print data, and it is sufficient for at least the upper limit value of the total weight of ink drops with respect to the paper P to become small in order to reduce the printing duty. In other words, in a case in which ink ejection is conducted based on print data for ejecting as many ink drops as possible onto the paper P, it is sufficient for the total weight of the ink drops to become small.

In the present embodiment, the settings of the margin amount and the printing duty are conducted as follows. Optimum combinations for preventing the paper P and the printing head 55 from contacting each other (paper rubbing) are obtained in advance by an experiment and the like corresponding to a plurality of parameters including the "print grade", the number of the print paths, the print resolution and the like, and stored in the ROM 32 as a table. When a necessary parameter is given, a corresponding combination of the margin amount and the printing duty is derived. FIGS. 13A and 13B show a relationship between the margin amount and the printing duty, and the head rubbing occurrence ratio. FIGS. 13A and 13B show an example in which the kind of the paper for printing is plain paper. As shown in FIG. 13A, when the "print grade" is standard, a combination in which the margin amount is 25 mm and the printing duty is 70% can be considered as the optimum among combinations of the margin amount (margins at the top and the bottom) and the printing duty in which the paper rubbing occurrence ratio is low. As shown in FIG. 13B, when the "print grade" is clean, a combination in which the margin amount is 25 mm and the printing duty is 100% can be considered as the optimum among combinations of the margin amount (margins at the top and the bottom) and the printing duty in which the paper rubbing occurrence ratio is low. In this manner, the optimum combination of the margin amount and the printing duty can be obtained for each parameter. In either case, it is considered that no reduction of the printing duty is better than no enlargement of the margin in terms of the print grade.

After the enlargement of the margin and the reduction of the printing duty are conducted, a confirmation screen is displayed (step S410) and a user operation is awaited (step S420). Although the display of the confirmation screen is not shown in the drawings, the confirmation screen can display a warning message such as "printing will be conducted with a larger margin amount than normal. If you agree, please press the OK button. In order to reset the print settings, please press the cancel button". When the OK button is pressed, printing is conducted with unidirectional printing (step S370), and the print process is ended. The reason why printing is conducted with unidirectional printing irrespective of a user selection in a case in which "strong rubbing prevention" is selected is because there is a strong likelihood that the print quality will be deteriorated if printing is conducted with bidirectional printing due to the platen gap PG increased to the second distance PG2 for "strong rubbing prevention". On the other hand, when the cancel button instead of the OK button is pressed, the print settings are reset (step S430), and the procedure returns to step S310. Then, the processes of step S310 to S420 are repeated in accordance with the print settings that have been reset, and the print process is ended.

Here, the correspondence relationship between the elements of the present embodiment and the elements of the invention will be clarified. The printing head 55 of the present embodiment corresponds to the "head" of the invention. The printer engine 26*a* and the printer ASIC 26*b* correspond to the "printing mechanism". The device including the main controller 30 corresponds to the "print control device", and for example, the printer 20 can correspond to the print control device. The platen gap adjusting mechanism 70 corresponds to the "distance adjusting means". The CPU 31 of the main controller 30 that executes the rubbing prevention setting process of FIG. 6 corresponds to the "enlarged margin printing selection means". The CPU 31 of the main controller 30 that executes the borderless setting process of FIG. 8 corresponds to the "borderless printing selection means". The CPU 31 of the main controller 30 that executes the process of step S390 for enlarging the margin amount corresponds to the "enlarged margin amount setting means". The carriage 52 and the carriage motor 57*a* correspond to the "movement means". The CPU 31 of the main controller 30 that executes the processes of steps S250 and S270 of the borderless setting process corresponds to the "margin amount setting means". The CPU 31 of the main controller 30 that outputs a control signal to the display section 37 of the operation panel 36 through the I/F 35 or transmits transmission data to the computer 10 through the USB device controller 28 corresponds to the "notification means". In the present embodiment, an example of the printing method of the invention is described by explaining the operation of the printer 20.

According to the printer of the present embodiment described above, by conducting printing with an enlarged margin amount of the paper P, the paper P can be prevented from swelling due to the ejected ink, and the paper P and the printing head 55 can be prevented from contacting each other (paper rubbing). In a case in which printing is conducted with an enlarged margin amount, since the distance (the platen gap) between the printing head 55 and the platen 50 is increased in addition to enlargement of the margin amount, paper rubbing can be more effectively prevented from occurring. Further, since the printing duty is reduced in addition to enlargement of the margin amount, the effect of preventing paper rubbing can be improved. In this case, the relationship between various kinds of parameters such as print grade, and the margin amount and the printing duty is obtained in advance and is stored as a table. When a necessary parameter is given, the margin amount and the printing duty are set by a corresponding combination of the margin amount and the printing duty is derived from the table. Therefore, paper rubbing can be more effectively prevented from occurring compared to a case in which the margin amount and the printing duty are set independently.

According to the printer 20 of the present embodiment, in a case in which printing is conducted with an enlarged margin amount of the paper P (in a case in which "strong rubbing prevention" is selected in "rubbing prevention settings"), "without border" cannot be selected in the "borderless settings" and the reason is displayed at the same time. Therefore, a user can freely select changing the "rubbing prevention settings" or continuing the printing "with border".

According to the printer 20 of the present embodiment, in a case in which printing is conducted with an enlarged margin amount of the paper P, the printing is conducted with unidirectional printing. Therefore, the print quality can be prevented from being deteriorated compared to a case in which printing is conducted with bidirectional printing.

According to the printer 20 of the present embodiment, in a case in which printing is conducted with an enlarged margin amount of the paper P, a confirmation screen is displayed prior to execution of printing. Therefore, print results that a user does not expect can be prevented from occurring.

According to the printer 20 of the present embodiment, the default setting of the "rubbing prevention settings" is "No". Therefore, a user can select "strong rubbing prevention" and conduct printing with an enlarged margin only when it is really necessary.

The invention is not limited to the above-described embodiment. It is apparent that various embodiments are possible as long as they belong to the technical scope of the invention.

For example, in the above-described embodiment, in a case in which "strong rubbing prevention" is selected for the "rubbing prevention settings", printing is conducted with an enlarged margin amount of the paper P. However, the invention is not limited to this. For example, in a case in which horizontal grain paper whose fiber direction is perpendicular to the feed direction is set on the paper feed tray 21 as the paper P, printing can be conducted with an enlarged margin amount. In a case in which vertical grain paper whose fiber direction coincides with the feed direction is set on the paper feed tray 21 as the paper P, printing can be conducted without an enlarged margin amount. When the paper P absorbs moisture due to ejected ink, a curl occurs more often in the perpendicular direction than in the parallel direction with respect to the fiber direction. Since the delivery roller 44 is disposed in a direction perpendicular to the feed direction of the paper P, floating can be easily controlled by the delivery roller 44 in a case of vertical grain paper even if the paper absorbs moisture of ink. On the other hand, in a case of horizontal grain paper, since the direction of disposing the delivery roller 44 and the direction of the curl coincide with each other, it is more difficult to control floating by the delivery roller 44 compared to a case of vertical grain paper. Therefore, in a case in which horizontal grain paper is set on the paper feed tray 21, by conducting printing with an enlarged margin amount, the paper P and the printing head 55 can be effectively prevented from contacting each other. Alternatively, in a case in which the paper P is set in the horizontal direction, printing can be conducted with an enlarged margin amount, and in a case in which the paper P is set in the vertical direction, printing can be conducted without an enlarged margin amount. It can be configured such that a user is allowed to judge whether the paper P set on the paper feed tray 21 is horizontal grain paper or vertical grain paper, or judge whether the paper P is set in the horizontal direction or in the vertical direction with respect to the paper feed tray 21. It can also be possible to detect the state of the paper P using a separate sensor.

In the above-described embodiment, the reduction of the printing duty is conducted in addition to the enlargement of the margin amount. However, the invention is not limited to this. The reduction of the printing duty can not be conducted. In such a case, an actual printing duty can be calculated by counting the dot number from print data generated based on image data, and the margin amount can be set based on the calculated printing duty. In such a case, it can also be possible to set the margin amount based on a plurality of parameters such as the printing duty, the print grade, and the like.

In the above-described embodiment, the margin amount of the paper P is enlarged by reducing image data. However, the invention is not limited to this. The margin amount of the paper P can be enlarged by trimming a margin area of image data.

In the above-described embodiment, in a case in which printing is conducted with an enlarged margin amount, the platen gap PG is increased to the second distance PG2. However, the invention is not limited to this. The platen gap PG can be increased to the first distance PG 1, or the platen gap PG can not be increased.

In the above-described embodiment, in a case in which "strong rubbing prevention" is selected for the "rubbing prevention settings", unidirectional printing is determined for the "bidirectional printing settings" (step S180). However, the invention is not limited to this. For example, in a case in which "weak rubbing prevention" is selected for the "rubbing prevention settings", unidirectional printing can be determined for the "bidirectional printing settings". In such a case, even if the platen gap PG is increased to the first distance PG1, it is possible to reduce the possibility that the image quality will be deteriorated by conducting unidirectional printing.

In the above-described embodiment, in a case in which printing is conducted with an enlarged margin amount of the paper P, a confirmation screen is displayed prior to conducting printing, so that the print settings can be reset by user's instructions. However, the invention is not limited to this. It can be configured such that a user is only notified that printing is conducted with an enlarged margin amount. Alternatively, it can be configured such that printing is conducted with an enlarged margin amount without the above-described notification.

In the above-described embodiment, a process of enlarging a margin amount of the paper P (a process of reducing image data) is conducted by the printer 20 that includes the main controller 30. However, the invention is not limited to this. It can be configured such that the process of enlarging the margin amount is conducted by a printer driver that is installed on the computer 10, and printing is conducted by the printer 20 that receives the image data after the process transmitted from the computer 10. In such a case, the computer 10 for enabling the function of the printer driver corresponds to the print control device.

In the above-described embodiment, it is considered that no reduction of the printing duty is better than no enlargement of the margin in terms of the print grade. Therefore, when the "print grade" is standard, a combination in which the margin amount is 25 mm and the printing duty is 70% is selected from the combinations shown in FIG. 13A, and when the "print grade" is clean, a combination in which the margin amount is 25 mm and the printing duty is 100% is selected from the combinations shown in FIG. 13B. However, a combination other than these can be selected. For example, if it is considered that no enlargement of the margin is better than no reduction of the printing duty, when the "print grade" is standard, a combination in which the margin amount is 5 mm and the printing duty is 50% can be selected from the combinations shown in FIG. 13A, and when the "print grade" is clean, a combination in which the margin amount is 15 mm and the printing duty is 80% can be selected from the combinations shown in FIG. 13B. The combination of the margin amount and the printing duty can be other than these combinations. It can also be configured such that a user is allowed to determine which of the margin amount and the printing duty is to be preferentially considered.

In the above-described embodiment, in the printing head 55, a voltage is applied to the piezoelectric element 66 and the piezoelectric element 66 is deformed so as to apply pressure to ink. However, another method can be employed, in which a voltage is applied to a heat element (for example, a heater) and ink is heated so as to apply pressure to ink by generated air bubbles. Also, in the above-described embodiment, a so-called on-carriage configuration is employed, in which the ink cartridge 56 is installed on the carriage 52 that moves forward and backward. However, a so-called off-carriage configuration can be employed, in which an ink cartridge is mounted on the mechanical frame 80 and ink is supplied from the ink cartridge to the printing head through a tube.

In the above-described embodiment, a so-called serial inkjet printer is used as the printer 20, in which the printing head moves forward and backward in a direction perpendicular to the feed direction of the paper P. However, the invention is not limited to this. Another printer can be used, in which the paper P is fixed and the printing head moves in XY directions so as to cover the entire vertical width (X direction) of the paper P and the entire horizontal width (Y direction) of the paper P. Alternatively, a line inkjet printer can be used, in which the printing head is fixed so as not to move forward and backward and nozzles are arranged in a line shape on the printing head so as to cover the entire paper width. Here, in a case in which a line inkjet printer is used, unidirectional printing or bidirectional printing cannot be conducted because the printing head does not move forward and backward. However, the enlargement of the margin amount, the reduction of the printing duty, or the increase of the platen gap PG can be conducted.

What is claimed is:

1. A print control device comprising:

a head configured and arranged to eject liquid onto a medium;

a printing mechanism configured and arranged to conduct printing of an image onto the medium by the head; and an enlarged margin printing selection unit configured to determine whether the printing is to be conducted with enlarging a margin amount in the medium or not prior to conducting the printing, wherein the printing mechanism is controlled to conduct the printing with enlarging the margin amount in the medium compared to a set margin amount in the medium when the printing with enlarging the margin amount in the medium is selected by the enlarged margin printing selection unit, the printing mechanism includes a distance adjusting unit configured to adjust a distance between the head and the medium, and in a case in which the printing is conducted with enlarging the margin amount in the medium, the distance adjusting unit is controlled to make a distance between the head and the medium larger than that of a case in which the printing is conducted without enlarging the margin amount in the medium.

2. The print control device according to claim 1 further comprising:

a pair of delivery rollers configured and arranged to deliver the medium to a position that faces the head; and a pair of discharge rollers configured and arranged to discharge the medium from the position that faces the head, the pair of delivery rollers and the pair of discharge rollers being configured to deliver the medium in a state of being sandwiched by the rollers, and the printing mechanism being controlled to conduct the printing with enlarging the margin amount in each of top and bottom ends of the medium in a delivery direction.

3. A print control device comprising:

a head configured and arranged to eject liquid onto a medium;

a printing mechanism configured and arranged to conduct printing of an image onto the medium by the head; and an enlarged margin printing selection unit configured to determine whether the printing is to be conducted with enlarging a margin amount in the medium or not prior to conducting the printing, wherein the printing mechanism is controlled to conduct the printing with enlarging the margin amount in the medium compared to a set margin amount in the medium when the printing with enlarging the margin amount in the medium is selected by the enlarged margin printing selection unit, in a case in which the printing is conducted with enlarging the margin amount in the medium, the printing mechanism is controlled to make an ejection amount of liquid per unit area with respect to the medium smaller than that of a case in which the printing is conducted without enlarging the margin amount in the medium.

4. The print control device according to claim 3 further comprising:

a pair of delivery rollers configured and arranged to deliver the medium to a position that faces the head; and a pair of discharge rollers configured and arranged to discharge the medium from the position that faces the head, the pair of delivery rollers and the pair of discharge rollers being configured to deliver the medium in a state of being sandwiched by the rollers, and the printing mechanism being controlled to conduct the printing with enlarging the margin amount in each of top and bottom ends of the medium in a delivery direction.

5. A print control device comprising:

a head configured and arranged to eject liquid onto a medium;

a movement unit configured to move the head forward and backward;

a printing mechanism configured and arranged to conduct printing of an image onto the medium by the head; and an enlarged margin printing selection unit configured to determine whether the printing is to be conducted with enlarging a margin amount in the medium or not prior to conducting the printing, wherein the printing mechanism is controlled to conduct the printing with enlarging the margin amount in the medium compared to a set margin amount in the medium when the printing with enlarging the margin amount in the medium is selected by the enlarged margin printing selection unit, the printing mechanism is controlled to conduct printing in a unidirectional printing mode in which printing is conducted by ejecting liquid from the head in only one of forward movement and backward movement, or in a bidirectional printing mode in which printing is conducted by ejecting liquid from the head in both of forward movement and backward movement, and in a case in which the printing is conducted with enlarging the margin amount, the printing mechanism is controlled to conduct the printing in the unidirectional printing mode.

6. The print control device according to claim 5 further comprising:

a pair of delivery rollers configured and arranged to deliver the medium to a position that faces the head; and a pair of discharge rollers configured and arranged to discharge the medium from the position that faces the head, the pair of delivery rollers and the pair of discharge rollers being configured to deliver the medium in a state of being sandwiched by the rollers, and the printing mechanism being controlled to conduct the printing with enlarging the margin amount in each of top and bottom ends of the medium in a delivery direction.

7. A printing device for conducting printing of an image to a medium by ejecting liquid onto the medium based on control by a print control device that includes a margin amount setting unit for setting a margin amount by a selection of a user, comprising:

a head for ejecting liquid;

a distance adjusting unit for adjusting a distance between the head and the medium; and a control unit for selecting one of a plurality of print modes including a first print mode in which a distance between the head and the medium is adjusted to be a first distance by the distance adjusting unit and printing is conducted based on a margin amount set by the margin amount setting unit and a second print mode in which a distance between the head and the medium is adjusted to be a second distance that is larger than the first distance by the distance adjusting unit and printing is conducted based on a margin amount that is larger than the margin amount set by the margin amount setting means, and controlling the head and the distance adjusting unit to conduct printing in the selected print mode.

8. A printing method comprising:

determining whether printing is to be conducted with enlarging a margin amount in a medium or not by an enlarged margin printing selection unit prior to conducting the printing; and conducting printing of an image to a medium by ejecting liquid from a head onto the medium with enlarging the margin amount in the medium compared to a set margin amount in the medium when the printing with enlarging the margin amount in the medium is selected by the enlarged margin printing selection unit, wherein a margin amount is set by a selection of a user, one of a plurality of print modes is selected, the plurality of print modes including a first print mode in which a distance between the head and the medium is adjusted to be a first distance and printing is conducted based on the set margin amount and a second print mode in which a distance between the head and the medium is adjusted to be a second distance that is larger than the first distance and printing is conducted based on a margin amount that is larger than the set margin amount set, and printing is conducted in the selected print mode.

* * * * *